US006648379B1

(12) United States Patent
Kordowski et al.

(10) Patent No.: US 6,648,379 B1
(45) Date of Patent: Nov. 18, 2003

(54) MOTOR VEHICLE DOOR LOCK OR THE LIKE

(75) Inventors: Bernhard Kordowski, Dortmund (DE); Bernd Weyerstall, Wuppertal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/550,597

(22) Filed: Apr. 17, 2000

(30) Foreign Application Priority Data

Apr. 16, 1999 (DE) ..... 199 17 264
May 28, 1999 (DE) ..... 199 24 447

(51) Int. Cl.[7] ..... E05C 3/06; E05C 3/16

(52) U.S. Cl. ..... 292/201; 292/216; 292/DIG. 65; 70/279

(58) Field of Search ..... 277/201, 216, 277/336.3, DIG. 22, DIG. 64, DIG. 53; 70/279

(56) References Cited

U.S. PATENT DOCUMENTS 4,796,932 A * 1/1989 Tame ..... 292/112
4,995,654 A * 2/1991 Nishigami et al. ..... 292/216
5,409,273 A * 4/1995 Claar et al. ..... 292/201
5,497,641 A * 3/1996 Linde et al. ..... 70/257
5,667,260 A * 9/1997 Weyerstall ..... 292/201
5,802,894 A * 9/1998 Jahrsetz et al. ..... 70/264
5,992,194 A * 11/1999 Baukholt et al. ..... 70/279.1
6,050,117 A * 4/2000 Weyerstall ..... 70/277
6,062,613 A * 5/2000 Jung et al. ..... 292/201
6,113,161 A * 9/2000 Jung et al. ..... 292/216
6,148,651 A * 11/2000 Roncin ..... 70/264
6,389,875 B1 * 5/2002 Barnett et al. ..... 73/1.37
6,415,752 B1 * 7/2002 Janak ..... 123/90.12

FOREIGN PATENT DOCUMENTS

DE 32 42 527 C3 5/1984
DE 42 19 210 A1 12/1993
DE 197 14 992 9/1994
DE 195 01 493 7/1996
DE 196 17 038 11/1997
DE 196 42 698 4/1998
DE 297 08 857 7/1998
DE 198 16 603 8/1999

* cited by examiner

*Primary Examiner*—Anthony Knight
*Assistant Examiner*—Vishal Patel
(74) *Attorney, Agent, or Firm*—Nixon Peabody LLP; David S. Safran

(57) ABSTRACT

A motor vehicle door lock or the like including a housing with a lock latch and a detent pawl located therein, an electrical opening aid for electrical actuation of the detent pawl in a normal state, a lock mechanism for mechanical actuation of the detent pawl in a special state, remotely controllable control electronics for remote operation of the door lock, a chain of force exerting components that runs from an outside door handle into the lock mechanism, and a plurality of electrical sensors assigned to the chain of force exerting components in the lock mechanism, the plurality of electrical sensors being adapted to trigger the switching functions of the control electronics and the opening aid.

16 Claims, 3 Drawing Sheets

MOTOR VEHICLE DOOR LOCK OR THE LIKE

BACKGROUND OF THE INVENTION

1. Field of the Invention

The invention relates to a motor vehicle door lock or the like that is an electric lock which is actuated by sensors in the lock mechanism. The present invention is also applicable to motor vehicle hood locks, hatch locks, etc.

2. Description of Related Art

A known motor vehicle door lock of the type to which the present invention is directed is disclosed in published German Patent Application DE-A-196 31 869 and corresponding, commonly owned, co-pending U.S. patent application Ser. No. 09/147,649. This lock is an electromechanical motor vehicle door lock in which the actuation of the detent pawl is produced, especially from the outside door handle or the inside door handle, by a chain of action of mechanical forces, while unlocking and locking of the door lock normally take place by means of an electronic remote control and an electrical central locking system drive. In an emergency, the unlocking function can also be performed mechanically from a closing cylinder on the door, such as the driver's door.

In the above explained known motor vehicle door lock, there is a crash switch by which, in an accident, the lock mechanism is immediately shifted into the "unlocked" operating position independently of the control electronics so that actuation of the inside door handle immediately causes the detent pawl to be lifted.

Moreover, it is known from the above mentioned patent application that electrical actuation of the detent pawl can be attained by providing an electrical opening aid. One such purely electrically activated motor vehicle door lock is generally called an "electric lock." In the explained prior art, this "electric lock" has a lock mechanism for mechanical activation of the detent pawl in case of an emergency.

In a motor vehicle door lock with the "passive entry" function, it is assumed that only the approach of an operator to the motor vehicle triggers a corresponding opening of the door or other functions.

The use of an "electric lock," especially in conjunction with the "passive entry" function, instead of a known mechanical motor vehicle door lock with an electrical central locking system has long resulted in the door handle fittings needing to be modified or replaced because, instead of or in addition to the chain of action of a force which runs into the lock mechanism, various microswitches for actuating the electrical opening aid must be attached and connected to the motor vehicle door lock, specifically the control electronic located there, by means of corresponding cables.

Therefore, there exists an unfulfilled need for a motor vehicle door lock which can work as a pure electric lock and which is also suited for performing a "passive entry" function. There also exists an unfulfilled need for such a motor vehicle door lock which allows ensured operation even when the electric power supply fails for whatever reason, including an accident. Moreover, there exists an unfulfilled need for such a motor vehicle door lock that can be used as a replacement for conventional motor vehicle door locks.

SUMMARY OF THE INVENTION

The primary object of the present invention is to devise a motor vehicle door lock which can work as a pure electric lock and which is also suited for a "passive entry" function.
.

Another object of the present invention is to provide such a motor vehicle door lock which allows ensured operation even when the electric power supply fails.

Yet another object of the present invention is to provide such a motor vehicle door lock that can be used as a replacement for conventional motor vehicle door locks.

In accordance with preferred embodiments of the present invention, these objects are obtained by an improved motor vehicle door lock that is an electric lock which is actuated by sensors in the lock mechanism. Therefore, in normal use, the chains of action of force from the outside door handle, the inside door handle, and optionally, the closing cylinder in the lock mechanics are used only to actuate the corresponding switches or to influence the corresponding sensors. As a result of existence of the chain or chains of action of mechanical forces, the lock mechanism can be used in a split second to activate the detent pawl, etc. in an emergency. In the implementation of an overrun function in which, for example, the outside door handle must be activated only up to a pressure point to trigger the electric function, no-load operation can be assigned to the chain of action of the force in the lock mechanism, such that the actuation of the outside door handle in the normal state takes place without exerting force on the detent pawl. Only in the special state, where there is a corresponding further pulling of the outside door handle beyond the pressure point, does the mechanical activation of the detent pawl take place.

According to the preferred embodiments of the present invention, however, there is a coupling switch which, in the special state, couples the chain of action of force, the chain of action of force being decoupled from the lock mechanism in the normal state. Thus, by moving the lock mechanism, mechanical actuation of the detent pawl can take place.

In addition to the above explained advantages, the motor vehicle door lock in accordance with the present invention has a major advantage in that it can be easily used as a replacement for conventional motor vehicle door locks. In particular, the outside door handles and the inside door handles of typical motor vehicle door locks can continue to be used simply with a central locking system and can also continue to work as before in the same way. The motor vehicle door lock in the present invention assigns to the outside door handles and inside door handles apparent mechanical functions in the normal state. In fact, only the electrical sensors in the lock mechanism are influenced. Only in the special state do the outside door handles and inside door handles and optionally a closing cylinder, act purely mechanically in the typical manner.

The reaction times are shortened so dramatically by the state changes in the motor vehicle door lock in accordance with the present invention which operates by purely electrical processes in the normal state, that extraordinarily low response times down to 100 ms are achieved.

These and other objects, features and advantages of the present invention will become more apparent from the following detailed description of the preferred embodiment of the invention when viewed in conjunction with the accompanying drawings.

DETAILED DESCRIPTION OF THE PREFERRED EMBODIMENT

In the various drawings discussed herein below, the motor vehicle door lock in accordance with the present invention has been shown in a simplified manner with various individual components omitted so that the teachings of the invention can be easily recognized. Thus, those parts and components of the motor vehicle door lock which due not play a role in the action of the invention are either not shown at all, or are not provided with reference numbers. Moreover, whereas the discussions below specifically illustrate and discuss motor vehicle door locks, the present invention may also be applied in a corresponding manner to motor vehicle hood locks, hatch locks, etc., so that the term "motor vehicle door lock" as used hereinbelow should always be understood in this broader sense to be inclusive of these other locks as well.

Figure 1:
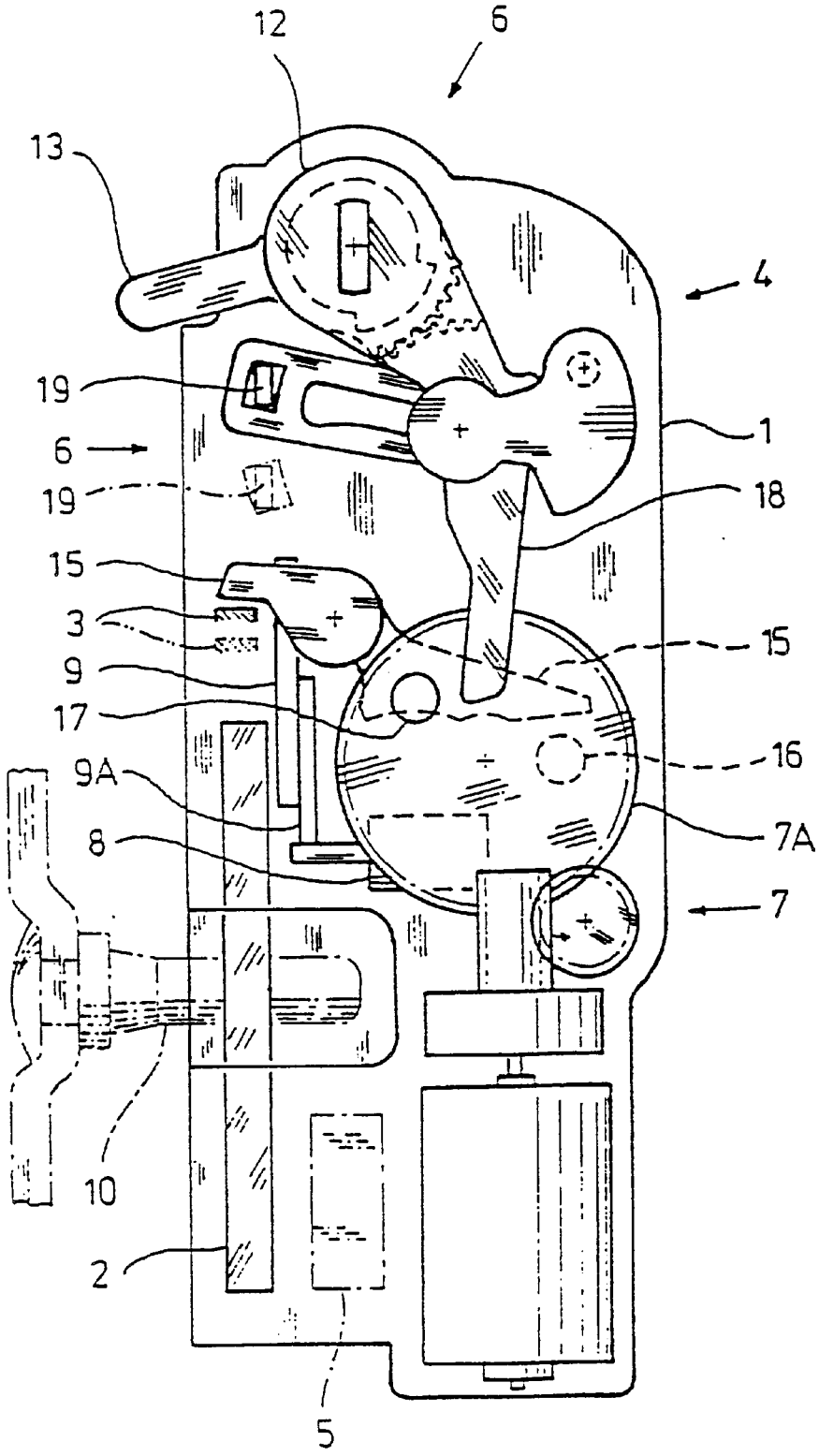
FIG. 1 shows one embodiment of a motor vehicle door lock in accordance with the present invention viewed in the direction in which the key collar drops.
Figure 2:
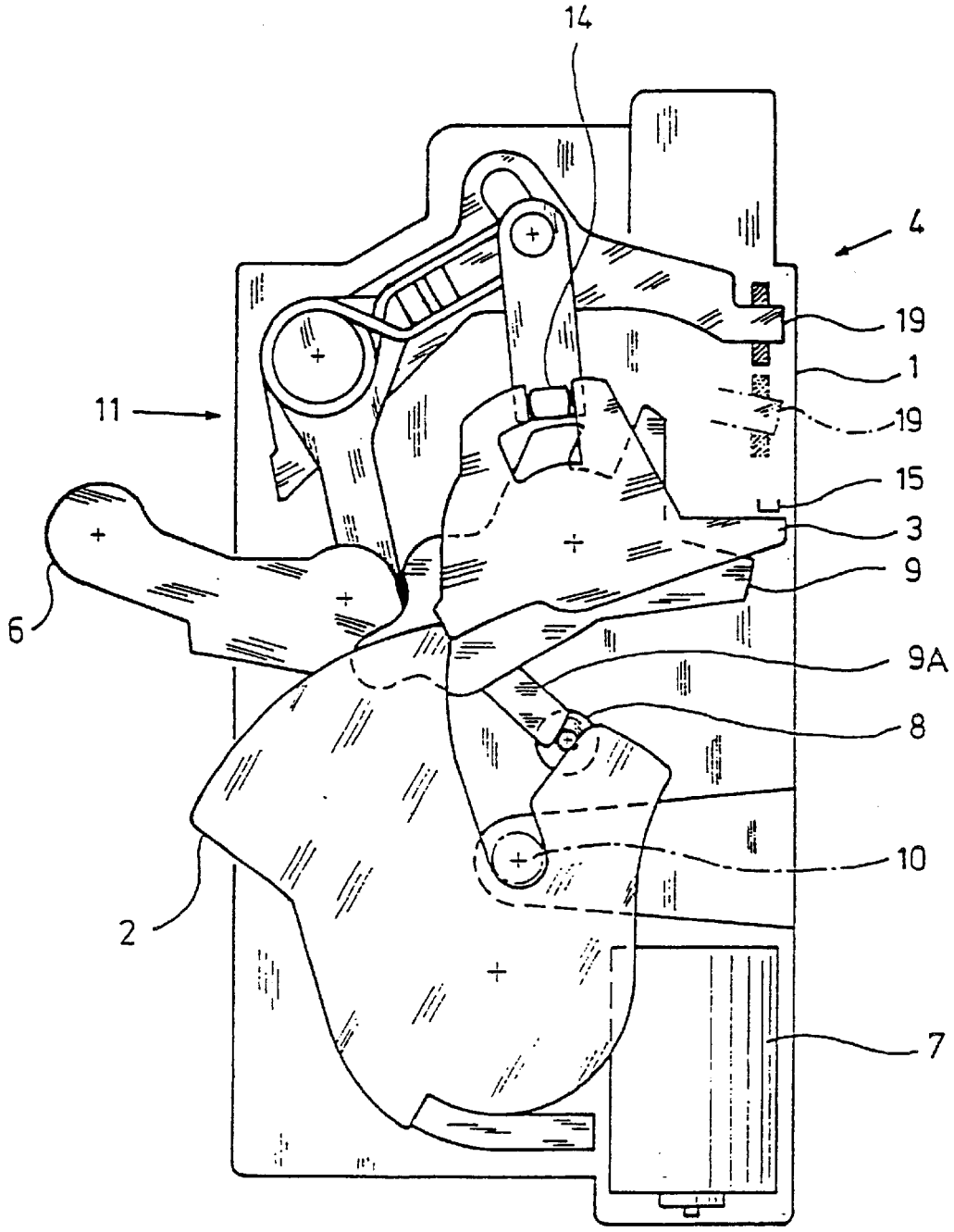
FIG. 2 is a side view the motor vehicle door lock of FIG. 1.

The subject matter of the invention is a motor vehicle door lock as shown in FIGS. 1 and 2 with a housing 1 having a lock latch 2 and a detent pawl 3 located therein. A lock mechanism 4 for mechanical actuation of the detent pawl 3 is also provided and is remotely controllable via control electronics 5, operable by a window module with an operator. The motor vehicle door lock has a chain 6 of force exerting components which runs from an outside door handle, and optionally, also from other actuating elements into the lock mechanism 4, and several corresponding chains of force exerting components 6. Furthermore, there is an electrical opening aid 7 for electrical actuation of the detent pawl 3. The electrical opening aid 7 is made here, in the conventional manner, as a worm wheel drive, for which further explanation is unnecessary in view of the well recognized prior art.

The motor vehicle door lock in accordance with the present invention also includes electrical sensors assigned to the chain of force exerting components 6 in the lock mechanism 4. In particular, these sensors can trigger the switching functions of the control electronics 5 and the opening aid 7 so that in the normal state, only electrical triggering of the switching functions takes place.

In the preferred embodiment shown in FIGS. 1 and 2, there is an "activation function." This means that there is a coupling switch 8 by which, in a special state, mechanical coupling of the chain of force exerting components 6 to the lock mechanism 4 takes place so that mechanical activation of the detent pawl 3 can then take place. Conversely, an "overrun function" can be accomplished in which electrical triggering of switching functions easily takes place so quickly that, in practice, there is no mechanical triggering of the switching functions. This can be supported by the corresponding pressure points, for example, on the outside door handle. In this "overrun" function, essentially nothing needs to be changed on the actuation elements.

Feasibly, the special state may be defined as a certain power supply voltage not being reached and/or by a vehicle crash.

FIGS. 1 and 2 show, by the broken line, the engagement of the key collar 10 with the lock latch 2, which here, is made as a forked latch as is apparent in FIG. 2.

The motor vehicle door lock in accordance with the present invention is preferably made as an electric lock and is suitable for the "passive entry" function because the state changes, including the opening function "open by wire," proceeds in less than 100 ms. For this reason, the motor vehicle door lock, in the normal state, has the behavior of a normal electric lock, and therefore, provides a purely electrically actuated motor vehicle door lock.

But atypical of an electrical lock, conventional mechanical actuation elements are used, such as an outside door handle, an inside door handle, and optionally a closing cylinder, which are connected via chains of action of mechanical forces to the lock mechanism 4. To this extent, the motor vehicle door lock in accordance with the present invention partially has the structure of known motor vehicle door locks which operate purely mechanically or mechanical motor vehicle door locks with central electrical locking system.

When a mechanical actuation element is actuated, only one sensor is actuated in the lock mechanism 4 during normal operations which, then, activates the corresponding function. Here, this generally includes functions to achieve the operating positions "locked," "unlocked," "antitheft," and optionally, "childproof" as well as the "door opening" function (open by wire). Also, there can be a pull-shut aid which then dictates a further "pull shut" function. The control electronics 5 trigger the corresponding functions just as in a conventional electric lock, such as those disclosed in the published German patent application DE 196 31 869 A1 and co-pending U.S. patent application Ser. No. 09/147,649, which is hereby incorporated by reference to facilitate an understanding of the present invention.

By changing the operating states based on electronic control, the reaction times are so short that the aforementioned time threshold need not be reached.

If the voltage to supply the motor vehicle drops below a certain value, whether because the vehicle voltage drops or because the power supply has been interrupted, the lock mechanism 4, in the embodiment shown, automatically switches to mechanical actuation by means of the coupling switch 8. To do this, the coupling switch 8 couples the chain of force exerting components 6 to the lock mechanism 4. The sensors are then superfluous and the respective function is mechanically triggered. This can apply to all function or alternatively, to only some functions, especially the "door opening" function.

A corresponding measure can be taken as soon as a special state, such as a crash or collision of the motor vehicle, occurs. While in the special state, when a certain power supply voltage is not reached, mechanical coupling of the chain of force exerting components 6 to the lock mechanism 4 does not require the operating position "locked" to be switched to "unlocked." Nor does this switching even seem desirable to prevent degradation of motor vehicle safety. Thus, when the special state is reached by a crash, it is recommended that automatic switching from the operating position "locked" into the operating position "unlocked" take place. This automatic switching has the advantage in that rescue personnel or the passenger can easily and immediately open the door.

In this way, even in the de-energized state or after an accident, all necessary functions can continue to be used mechanically.

The embodiment shown in FIGS. 1 and 2 illustrates that the lock mechanism 4 is in the "locked" operating position in the normal state shown here. In this operating position, mechanical actuation of actuation elements, such as the outside door handle, are only idle and only the sensors are actuated.

Moreover, as noted previously, this embodiment of a motor vehicle door lock includes an electrical central locking system drive. In the present embodiment, the central locking system drive is integrated with the electrical opening aid 7. This is accomplished by the electrical opening aid 7 which works as the opening aid by rotating the worm wheel 7*a* in one direction and as the central locking system drive by rotating the worm wheel 7*a* in the opposite direction.

Figure 3:
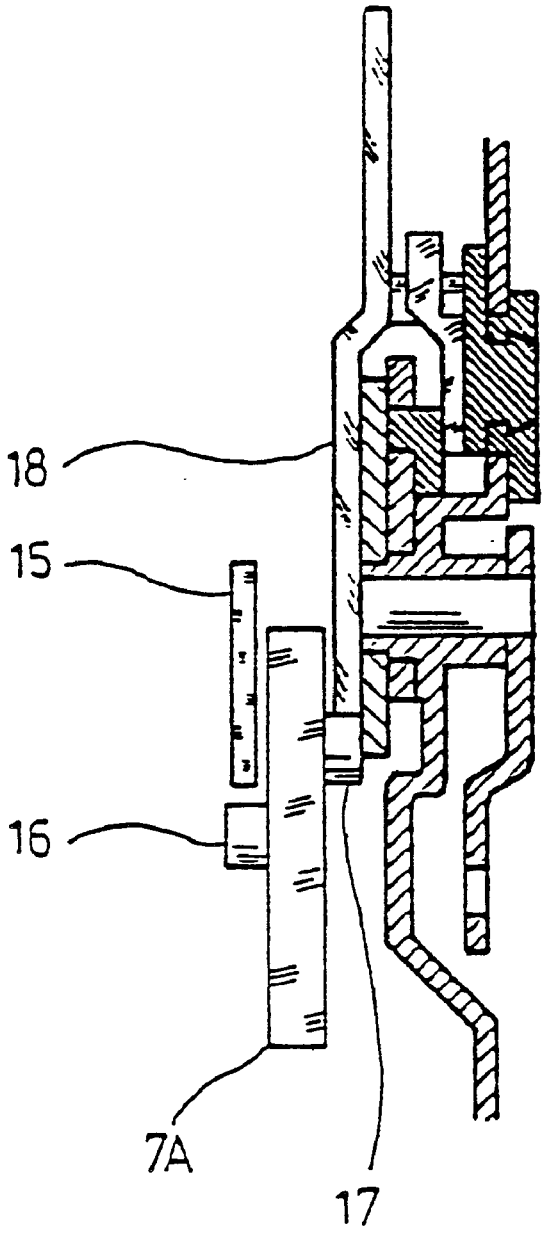
FIG. 3 is a cross-sectional view of the components of the motor vehicle door lock of FIG. 1.

In this embodiment, as shown in FIG. 1, a release lever 15 is provided which is able to interact with the detent pawl 3 and is supported on a pivot axis such that, when the end which is on the right in FIG. 1 is lifted, the lever 15 presses down on the end of the pawl 3 that is away from the lock latch 2 (in FIG. 2, this is the end which is on the right) and actuates the detent pawl 3 which is shown on the left in FIG. 1. The detent pawl journal 16 which is shown in broken lines on the right in FIG. 1 because it is hidden in that view, is recognizable on the worm wheel 7*a* in FIG. 3 and is driven in the "open by wire function" by counterclockwise rotation of the worm wheel 7*a* against the release lever 15, the lever 15 being swung to release the detent pawl 3 until it stops. Then, the detent pawl journal 16 is returned to the starting position by turning the worm wheel 7*a* back. If, for example, the outside door handle continues to be pulled in this embodiment, the worm wheel 7*a* can also remain stationary on the stop until the outside door handle is released again. Only afterwards is the detent pawl 3 released again and can go back into the neutral position.

The electrical opening aid 7 has the function of the central locking system drive in the embodiment of FIG. 1 when the worm wheel 7*a* is turned clockwise. In this operation, the central locking system journal 17 runs clockwise for engaging the arm of an unlocking lever 18, i.e., the arm which projects downwards, so that the lock mechanism 4 is shifted into the "unlocked" operating position by the lever 18. This function of the preferred embodiment of a motor vehicle door lock in accordance with the present invention is especially important in the case of a crash, as previously explained above.

This embodiment shows the implementation of the coupling switch 8 as a solenoid actuator with two positions (double stroke solenoid actuator). So that current need not necessarily be supplied to it normally, it is provided here that the special state is accomplished by current being supplied to the solenoid actuator of the coupling switch 8. To do this, an emergency power source is needed, such as in the form of a storage capacitor which is activated in the special state. Accordingly, the normal state is likewise accomplished by supplying current to the solenoid actuator to move the solenoid actuator in the opposite direction. It is important that the solenoid actuator which forms the coupling switch 8 draws no static current in this embodiment.

This embodiment shows the coupling switch 8 for a force transfer mechanism 11, which, in the special state, releases a spring-loaded lever 9 thereby establishing mechanical coupling. This mechanical coupling takes place by the plunger of the solenoid actuator of the coupling switch 8 being retracted and releasing the lever 9. At the same time, the mechanical coupling takes place, on the one hand for actuation, of the detent pawl 3, and on the other hand, for coupling of a lock nut 12 which can be actuated proceeding from a closing cylinder (not shown) so as to provide for "unlocking" and "locking" of the motor vehicle door lock.

In this embodiment, on the spring-loaded lever 9, there is an auxiliary lever 9a which can also be an integral part of the spring-loaded lever 9. Here, it is shown as an individual lever. It is apparent how the extended plunger of the solenoid actuator which forms the coupling switch 8 prevents this auxiliary level 9a from continuing to move. In this way, in this embodiment, the entire force transfer mechanism 11 which assumes the operating position "locked" is, to a certain extent, blocked and it cannot leave this state. Only the electrical function is active. Only entering a special state changes this.

This embodiment shows that the spring loaded lever 9 interacts with the detent pawl 3 and in this embodiment, is supported even on the same axis as the detent pawl 3. In this embodiment, a spring-loaded coupling lever 14 is assigned to the spring loaded lever 9 and optionally establishes a force-transfer connection of the lever 9 to the detent pawl 3. This embodiment shows this on the bottom end of the coupling lever 14. The recesses which are recognizable there, on the one hand, those of the detent pawl 3, and on the other hand, those of the spring loaded lever 9, do not overlap in FIG. 2. Consequently, the force-transfer connection of the lever 9 to the detent pawl 3 is not established. However, if the coupling lever 14 is swung down relative to the position of FIG. 2 when the recesses of pawl 3 and lever 9 overlap, it establishes the force-transfer connection. In FIG. 2 on the right, the operating position "unlocked" of a pivot lever 19 of the force transfer mechanism 11 is shown by broken lines. The above explained force-transfer connection is then established.

The coupling lever 14 is entrained by swivelling of the detent pawl 3 which, in turn, is rotated by the opening aid 7 in a motorized manner into the open position without being shifted vertically in FIG. 2. It thus remains in the electrical actuation and the lock mechanism 4 remains in the "locked" operating position.

Proceeding from the state which is shown in FIG. 2, the operating position "unlocked" can be prepared by the force transfer mechanism 11 being moved into the operating position "unlocked" by the motion of the pivot lever 19 clockwise into the position shown by the broken line. If the detent pawl 3 is still in the position which is shown in FIG. 2, the coupling lever 14 is simply prestressed downward by spring force. Pivoting of the spring-loaded lever 9 in a counterclockwise direction causes the recesses of the pawl 3 and lever 9 to overlap so the coupling lever 14 can engage in them, and the above explained force-transfer connection is thereby established. This, then, corresponds to the special state with mechanical actuation of the detent pawl 3.

The tilt lever 19 is also apparent in FIG. 1 on the left, which at this point is again, in connection with the unlocking lever 18 and the lock nut 12. Operation of the lock nut 12 has already been explained above.

FIG. 1 shows a safety lever 13 which can be reached only with the motor vehicle door open. With this lever in the special state, the lock mechanism 4 switches from the "locked" operating position into the "unlocked" operating position if this cannot take place via the lock nut 12 from a closing cylinder. Furthermore, with the safety lever 13, mechanical resetting of the motor vehicle door lock into the normal state takes place when the prerequisites of the special state are no longer present.

In one such design which corresponds to one preferred embodiment, if the motor vehicle door is then closed again, a plunger of the solenoid actuator, which is made here as a coupling switch 8, prevents the spring-loaded lever 9 from springing back into its base position. In this way, the resetting of the system takes place. From then on, the motor vehicle door lock in accordance with the present invention works again as an electric lock.

The lock nut 12 can also be used from the outside for a different form of emergency actuation. If the power supply is interrupted, and accordingly, the access authorization cannot be electronically granted, it is necessary to turn the closing cylinder, and thus, part of the two-part lock nut 12 with a mechanical key. In this way, a switch is actuated which activates the emergency power supply from the storage capacitor or the like such that power is then supplied to the solenoid actuator which forms the coupling switch and the magnet draws the plunger in. In this way, the spring loaded lever 9 is then released in the above explained manner and the lock mechanism 4 is activated.

The motor vehicle door lock in accordance with the present invention can be used especially where there is already a structure with external inputs. Without the need to change the door handles, the motor vehicle door lock of the present invention replaces existing mechanical motor vehicle door locks with modern electrical lock structures. Sensors/microswitches on the door handles and their expensive cabling to the lock mechanism can be omitted and there is provided a perfect mechanical redundancy for special states, such as an emergency. At the same time, the motor vehicle door lock of the present invention is extremely fast and meets the time requirements for "passive entry."

While a single embodiment in accordance with the present invention has been shown and described, it is understood that the invention is not limited thereto. This embodiment may be changed, modified and further applied by those skilled in the art. Therefore, this invention is not limited to the details shown and described previously, but also includes all such changes and modifications which are encompassed by the appended claims.

What is claimed is:

1. Motor vehicle lock comprising:

a housing having a lock latch and a detent pawl located therein, the detent pawl being assigned to the lock latch and holding the lock latch in a closed position and releasing the lock latch in an actuated position;

an electrical opening aid for electrical actuation of the detent pawl in a normal operational state;

a lock mechanism for mechanical actuation of the detent pawl in a special operational state, the lock mechanism being adapted to be disabled relative to the detent pawl in said normal operational state;

remotely controllable control electronics for remote operation of the motor vehicle lock, a chain of force exerting components that extends from an outside door handle into the lock mechanism; and at least one electrical sensor assigned to a portion of the chain of force exerting components that is located within the lock mechanism, the at least one electrical sensor being adapted to trigger switching functions of the control electronics and the electrical opening aid, wherein, in the special operational state, the detent pawl is mechanically actuatable via the chain of force exerting components, and wherein, in the normal operational state, the at least one electrical sensor is operable to trigger the electrical opening aid to thereby electrically actuate the detent pawl by movement of the chain of force exerting components in response to operation of the outside door handle.

2. Motor vehicle lock of claim 1, further comprising a coupling switch, which in said special state, mechanically couples the chain of force exerting components to the lock mechanism to allow mechanical activation of the detent pawl.

3. Motor vehicle lock of claim 2, further comprising means for placing the coupling switch in said special state in response to at least one of a reduction in a power supply voltage and a vehicle crash.

4. Motor vehicle lock of claim 1, wherein in the normal operational state and when the lock mechanism is in a "locked" operating state, the lock mechanism is separated from the pawl such that mechanical actuation of an actuation element results in an idle stroke of the lock mechanism without movement of the detent pawl.

5. Motor vehicle lock of claim 1, further comprising a means for mechanically coupling the chain of force exerting components to the lock mechanism in the special state without switching the lock mechanism from a "locked" operating position into an "unlocked" operating position.

6. Motor vehicle lock of claim 5, wherein the means for mechanically coupling the chain of force exerting components to the lock mechanism is automatically responsive to detecting of the special state.

7. Motor vehicle lock of claim 1, further comprising an electrical central locking system drive which is integrated with the electrical opening aid.

8. Motor vehicle lock of claim 7, wherein the electrical opening aid is movable in forward direction to electrically actuate the detent pawl, and is movable in an opposite direction to actuate a central locking system.

9. Motor vehicle lock of claim 2, wherein the coupling switch is a solenoid actuator.

10. Motor vehicle lock of claim 9, wherein the solenoid actuator is a double stroke solenoid actuator having two stable positions in which no current is supplied.

11. Motor vehicle lock of claim 2, wherein the coupling switch is adapted to block displacement of a pivot lever in the normal state and to allow displacement of the pivot lever in the special state.

12. Motor vehicle lock of claim 11, wherein the pivot lever is disposed proximate to the detent pawl and is supported coaxially with the detent pawl.

13. Motor vehicle lock of claim 11, further comprising a spring-loaded coupling lever which engages the pivot lever and establishes a force-transfer connection between the pivot lever and the detent pawl.

14. Motor vehicle door lock of claim 13, wherein the coupling lever is adapted to be switched between an "unlocked" operating position and a "locked" operating position and is mechanically actuable by a lock nut.

15. Motor vehicle lock of claim 1, wherein the motor vehicle lock is a motor vehicle door lock.

16. Motor vehicle lock of claim 15, further comprising a safety lever means for allowing mechanical switching between "locked" and "unlocked" operating positions in the special state and for also allowing mechanical resetting of the motor vehicle door lock into the normal state from the special state, the safety lever means being accessible when a motor vehicle door having the motor vehicle door lock is opened.

* * * * *